US006209458B1

(12) United States Patent
Thomson et al.

(10) Patent No.: US 6,209,458 B1
(45) Date of Patent: Apr. 3, 2001

(54) INFLATABLE PLUGS FOR CHARGING BLASTHOLES

(75) Inventors: Stephen Thomson; Andrew M Gresham, both of New South Wales (AU)

(73) Assignee: Orica Australia Pty Ltd., Melbourne (AU)

( * ) Notice: Subject to any disclaimer, the term of this patent is extended or adjusted under 35 U.S.C. 154(b) by 0 days.

(21) Appl. No.: 09/297,377

(22) PCT Filed: Nov. 3, 1997

(86) PCT No.: PCT/AU97/00742

§ 371 Date: Jul. 6, 1999

§ 102(e) Date: Jul. 6, 1999

(87) PCT Pub. No.: WO98/20295

PCT Pub. Date: May 14, 1998

(30) Foreign Application Priority Data

Nov. 1, 1996 (AU) ..... P03398

(51) Int. Cl.[7] ..... F42B 3/00
(52) U.S. Cl. ..... 102/333; 102/313
(58) Field of Search ..... 102/312, 313, 102/333

(56) References Cited

U.S. PATENT DOCUMENTS

| | | | | |
|---|---|---|---|---|
| 3,696,703 | | 10/1972 | Fox | 86/20 C |
| 4,592,282 | * | 6/1986 | Niemi et al. | 102/313 |
| 5,000,261 | | 3/1991 | Fitzgibbon | 166/187 |
| 5,247,886 | * | 9/1993 | Worsey | 102/333 X |
| 5,253,586 | * | 10/1993 | Worsey | 102/313 |
| 5,273,110 | | 12/1993 | Fitzgibbon | 166/187 |
| 5,341,874 | | 8/1994 | Wilson | 166/196 |
| 5,979,327 | * | 11/1999 | Thomson | 102/333 |

FOREIGN PATENT DOCUMENTS

| | | |
|---|---|---|
| 96/21083 | 7/1996 | (WO) . |
| 97/17588 | 5/1997 | (WO) . |

* cited by examiner

*Primary Examiner*—Peter A. Nelson
(74) *Attorney, Agent, or Firm*—Pillsbury Winthrop LLP

(57) ABSTRACT

A device for locating and inflating a blasthole plug comprising;

Figure 1:
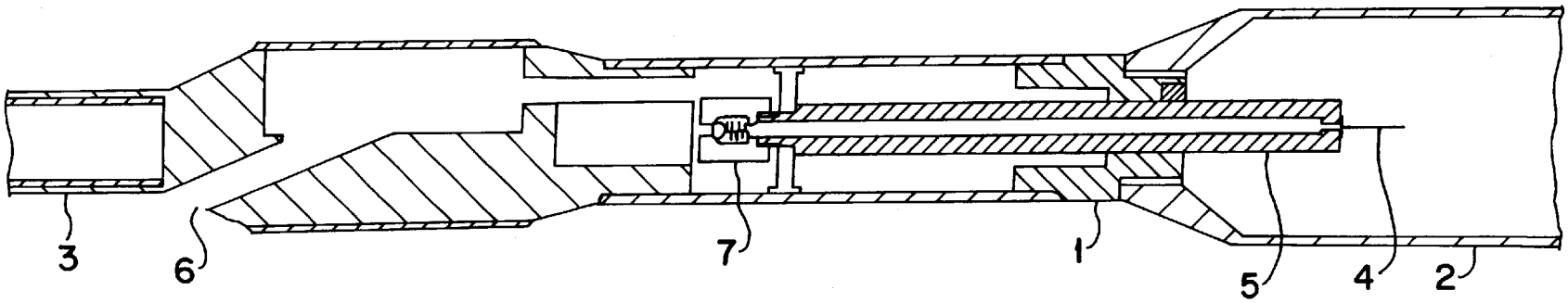

(i) a shroud adapted to enclose at least part of a deflated plug as the deflated plug is passed along a blasthole, (ii) an ejection means for removing the deflated plug from the shroud into a desired location in a blasthole, and (iii) an inflation means adapted to be removably connected to the plug, such that when the deflated plug is removed from the shroud, fluid material may be passed through the inflation means to inflate the plug.

6 Claims, 2 Drawing Sheets

INFLATABLE PLUGS FOR CHARGING BLASTHOLES

This application is the national phase of international application PCT/ AU97/00742 filed Nov. 3, 1997 which designated the U.S.

The present invention relates to a method and apparatus for use in charging blastholes. More particularly the present invention relates to a device for location and inflation of plugs in blastholes and a method of locating and inflating the plug in blastholes using the device of the present invention.

In mining operations the main objective of blasting is to break rock and shift material such as ore, rock, coal or the like in a useful way. When an explosive charge explodes there is a powerful force exerted in all directions and any earth surrounding the explosive charge will break along the line of least resistance. In order to achieve an optimal result in blasting the location and degree of confinement of an explosive charge must be carefully designed and blastholes drilled in appropriate locations. Factors such as the diameter, length, angle and spacing of the blastholes are critical to the success of a blast.

Charging a newly drilled blasthole with explosives generally involves careful placement of an initiation device such as a detonator, a primer and bulk explosive and/or packaged explosives in the blasthole. Detonators are small, compact, high energy explosives which can initiate a larger body of explosive such as a primer, which in turn may detonate with enough force to initiate bulk or packaged explosives. The nature, quantity and arrangement of the initiation device, primer and bulk or package explosive in a blasthole has a large influence on the results of a blast.

Often the blasthole is not completely filled with explosives. Often there is a gap between the top of the column of explosives and the open end of the blasthole (known as the "collar"). This gap may be either left open or filled with non-explosive material called stemming which helps to confine the charge and improve blast results.

Furthermore, the column itself may not necessarily be continuous from the closed end of the blasthole (known as the "toe") to the collar; sometimes the column comprises several charges or short columns separated by inert material or devices referred to as "decks" are inserted into blastholes to provide discontinuities in the column of explosives. Decking tends to lower the explosion pressure in a blasthole and provide a more even distribution of energy than can be achieved in the absence of decking.

In the past many attempts have been made to provide a blasthole plug which can perform the function of air decking and/or stemming. Desirably these plugs should also be suitable for plugging unwanted ruptures in a blasthole, such as when the blasthole has broken through into a tunnel, fissure or other discontinuity in the earth. In the past attempts have been made to stem blastholes using polymeric containers filled with water and sealed closed at each end. One end is well rounded for easy insertion of the containers into the blasthole where they are secured in place by driving a wedge made of wood or plastic material between the container and the blasthole wall. This type of stemming is inconvenient to use because of the difficulty of manually forcing a water filled container into a blasthole and then driving in wedges while avoiding rupturing the container. These containers are particularly difficult to place into upholes, that is blastholes which are drilled vertically upward or at an upward angle into the walls or roof of a mine because gravity tends to cause them to fall out of upholes. They are quite unsuitable for use in decking because of the difficulty of locating and maintaining them at the required position in a blasthole.

Another simple type of blasthole plug comprises an inflatable bag having a valve. The uninflated bag is lowered into a downhole on a string or pushed into an uphole or downhole using a stick or bulk explosives loading hose. The bag is then inflated using compressed air, the inflated bag engaging the walls of the blasthole and remaining in place by interference fit.

Australian Patent Application no. 41907/93 describes an inflatable blasthole plug for stemming or decking blastholes. This particular plug comprises a flexible, inflatable body member which is contained within an inflexible container. Inflation of the flexible member acts to engage the walls of a blasthole to keep the plug in place. It is particularly important that the plug remains in position when in use in an uphole to support a column of explosive in the uphole. This plug however does not necessarily eliminate the use of stemming material. Furthermore, such plugs are difficult to locate in position in a blasthole and it is not always possible for a performed, inflexible container to conform to the irregular cross section of a blasthole and thus form a seal.

Blastholes are commonly charged with bulk explosives by pumping or pneumatically conveying the bulk explosive through a loading hose into the blasthole. One of the drawbacks of most of the blasthole plugs of the prior art is that when such plugs are used for decking, it is necessary to interrupt the charging of the blasthole with explosive in order to put the plug in place.

In order to overcome these difficulties, other types of blasthole plugs have been developed which can be placed in position in a blasthole prior to charging. Generally these plugs comprise an outer member adapted to engage the walls of a blasthole and an inner member comprising a conduit through which bulk explosive material can be pumped or blown. A typical plug of this type is described in Australian Provisional Patent Application No. PN6377 corresponding to U.S. Pat. No. 5,979,327. The outer member of such a plug is generally inflatable and constructed of a deformable material such as rubber or synthetic polymers which provides a good contact between the plug and the walls of the blasthole. Any suitable liquid or gas or finely divided particulate matter can be used to inflate the outer member. Water and air are particularly inexpensive and convenient fluids for use in inflation.

While the inflatable plugs of the prior art have been relatively successful in use, they are often quite difficult to locate and hold the deflated plug in position in a blasthole prior to inflation, particularly in the very longest blastholes. Downholes in large mines may be at least 100 metres in length while upholes may be up to 60 metres in length. While the deflated plug can be lowered by a string into position in a downhole, this can be a relatively difficult task because the deflated plug and string tend to become hung up on the rough walls of the blasthole. Upholes are particularly problematic because the plug must be manoeuvred into place using a stick or a loading hose and held in position until inflated. This is clearly difficult as gravity tends to make the uninflated plug fall out of the uphole.

It has now been found that a device can be provided for relatively quick and simple location and inflation of plugs in blastholes.

The present invention provides a device for locating and inflating a blasthole plug comprising;

(i) a shroud adapted to enclose at least part of a deflated plug as the deflated plug is passed along a blasthole, (ii) an ejection means for removing the deflated plug from the shroud into a desired location in a blasthole, and (iii) an inflation means adapted to be removably connected to the plug, such that when the deflated plug is removed from the shroud, fluid material may be passed through the inflation means to inflate the plug.

The shroud may be generally cylindrical in shape and open at one end to receive the uninflated plug. As the uninflated plug is passed along a blasthole the shroud serves to protect the uninflated plug from the sides of the blasthole and avoid any damage due to the plug catching or tearing on pieces of rock or ore in the blasthole walls. The shroud may be sufficiently large to enclose the whole of the uninflated plug or just enough of the plug as to prevent damage of the plug as the locating device is moved along a blasthole.

The device of the current invention is preferably generally elongate and cylindrical to facilitate movement along blastholes. Preferably the device of the current invention comprises an elongate cylindrical barrel having a shroud at one end. More preferably the device of the current invention comprises a barrel having a shroud at one end and adapted to receive a bulk explosives loading hose at the other end. The bulk explosives loading hose may be removably attached to the device of the current invention and can be used to push or pull the device of the current invention along a blasthole.

The ejection means for removing the uninflated plug from the shroud into a desired location in a blasthole may comprise a piston or the like. Where the device of the current invention comprises a cylindrical barrel having a shroud at one end, the ejection means may reside partly or wholly within the barrel when not in use. During use the ejection means may project from the barrel into the shroud, pushing the uninflated plug out of the shroud.

The inflation means adapted to be removably connected to the plug may comprise an air or fluid needle or the like through which fluid material may be passed from the device of the current invention to inflate the plug. The inflation means may removably connect to the plug by interference fit in an orifice, by a screw fitting or any other convenient means. The inflation means may further comprise a ball valve or other means for controlling flow rate or preventing backflow of fluid materials through the inflation means. The fluid material may be any convenient gas, liquid or finely divided particulate matter.

The inflation means may be connected to or integral with the ejection means. In a particularly preferred embodiment the device of the present invention comprises a hollow piston having a fluid needle at one end and a check valve at the other end. In use, the uninflated plug is attached to the fluid needle; the piston is moved forward to remove the uninflated plug from the shroud and fluid is passed through the hollow piston and through the fluid needle to inflate the plug.

The plug for use with the device of the current invention may comprise any suitable inflatable plug known in the art. In its simplest form the plug comprises an inflatable bag having a filling valve. In a more complex form the plug is adapted-to permit fluid bulk explosive to be pumped through a passage in the plug into the blasthole.

The plug for use with the current invention may be of any convenient size and shape suitable for blocking off or plugging the blasthole in which it is used. Where the plug is used in upholes it may be necessary that the inflated plug holds its position sufficiently strongly in the blasthole to support a column of explosives. The inflation pressure of the plug will vary with size of the plug and the diameter of the blasthole in which it is used, but it is anticipated that inflation pressures of up to at least 200 kPa will be sufficient.

The present invention further provides a method of locating a plug in a desired position in a blasthole using the aforedescribed plug locating device, comprising the steps of;

(a) enclosing at least part of an uninflated plug within the shroud and passing the device along a blasthole, (b) using the ejection means to eject the uninflated plug from the shroud into a desired location in the blasthole, (c) passing fluid material through the inflation means to inflate the plug, (d) removing the inflation means from the inflated plug, and (e) removing the locating device from the blasthole.

In mines, the most convenient source of fluid material for inflating the plug is likely to be compressed air, the flow of which can be regulated by needle valve or the like.

While plugs are commonly located in blastholes to act as stemming or decking they may also be used to block holes where a blasthole has inadvertently been drilled to break into a fissure, void or old tunnel or the like. The device and method of the current invention is suitable for locating a plug in all such situations.

Figure 2:
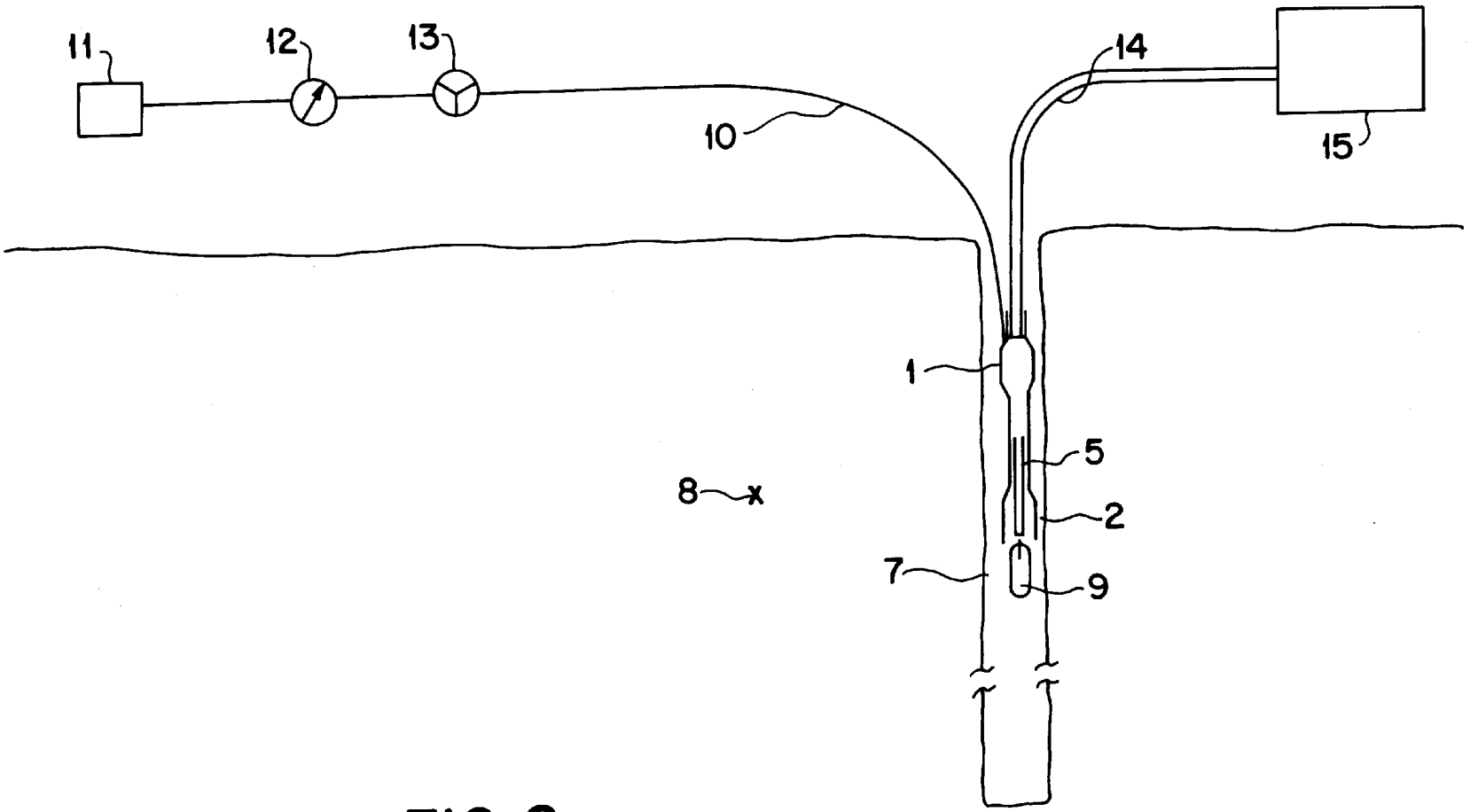

The method and device of the current invention will now be further described with reference to the drawings. FIG. 1 depicts a longitudinal cross-section of one embodiment of the plug locating device of the current invention; FIG. 2 depicts a plan of one embodiment of the plug locating device in use.

FIG. 1 shows a longitudinal view of one embodiment of the device of the current invention which has a cylindrical barrel (1) having a shroud (2) at one end and adapted at the other end (3) to receive a bulk explosives loading hose. A plug may be removably attached to the air needle (4) which is attached to a hollow piston (5). In use, compressed air may be passed through an inlet (6) in the barrel, the compressed air acting to move the piston, causing the plug to be pushed out of the shroud and then inflated. A check valve (7) prevents backflow of air and ensures the plug is pushed from the shroud before inflation begins. Once the plug is inflated the air needle can be removed from the inflated plug.

FIG. 2 shows a plan view of one embodiment of the plug locating devices in use in a blasthole (7) drilled in ore (8). A plug (9) is attached to the air needle of the device; the piston (5) to which the needle is attached has been used to remove the plug from the shroud (2). The piston has been activated by compressed air; an air line (10) attaches to the barrel (1) of the plug locating device and carries air from the mine service supply (11) through a regulator (12) and a three way valve (13). The compressed air activates the piston, then causes the plug to inflate. The end of the barrel is designed to receive the end of an explosives loading hose (14) from a mobile explosives manufacturing unit (15). The explosives loading hose may be removably attached to the plug locating device such that the device can be lowered and raised in the blasthole using the loading hose.

While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A device for locating and inflating a blasthole plug comprising;

(i) a shroud adapted to enclose at least part of a deflated plug as the deflated plug is passed along a blasthole, (ii) an ejection means for removing the deflated plug from the shroud into a desired location in a blasthole, and (iii) an inflation means adapted to be removably connected to the plug, such that when the deflated plug is removed from the shroud, fluid material may be passed through the inflation means to inflate the plug.

2. A device according to claim 1 which comprises an elongate cylindrical barrel having a generally cylindrical shroud at one end, and adapted to receive a bulk explosives loading hose at the other end.

3. A device according to claim 2 wherein the ejection means comprises a piston which resides partly or wholly within the barrel when not in use.

4. A device according to any of the preceding claims wherein the ejection means and the inflation means are connected or integral.

5. A device according to claim 4 wherein the ejection means and inflation means are integral and comprise a hollow piston having a fluid needle at one end and a check valve at the other end, wherein in use the uninflated plug is attached to the fluid needle, the piston is moved forward to remove the plug from the shroud and fluid is passed through the hollow piston and through the fluid needle in inflate the plug.

6. A method of locating and inflating a plug in a desired position in a blasthole using a locating and inflating device according to claim 1, comprising the steps of:

(a) enclosing at least part of an uninflated plug within the shroud and passing the device along a blasthole, (b) using the ejection means to eject the uninflated plug from the shroud into a desired location in the blasthole, (c) passing fluid material through the inflation means to inflate the plug, (d) removing the inflation means from the inflated plug, and (e) removing the device from the blasthole.

* * * * *